US010327572B2

(12) United States Patent
Seidler

(10) Patent No.: US 10,327,572 B2
(45) Date of Patent: Jun. 25, 2019

(54) DETACHABLE SELF-SUPPORTING DISPLAY DEVICE

(71) Applicant: Stewart Seidler, New York, NY (US)

(72) Inventor: Stewart Seidler, New York, NY (US)

(73) Assignee: CONCEPT WORKSHOP WORLDWIDE, LLC, New York, NY (US)

( * ) Notice: Subject to any disclaimer, the term of this patent is extended or adjusted under 35 U.S.C. 154(b) by 42 days.

(21) Appl. No.: 15/655,008

(22) Filed: Jul. 20, 2017

(65) Prior Publication Data

US 2018/0020850 A1 Jan. 25, 2018

Related U.S. Application Data

(60) Provisional application No. 62/365,702, filed on Jul. 22, 2016.

(51) Int. Cl.

| | |
|---|---|
| ***A47G 1/00*** | (2006.01) |
| ***A47G 1/16*** | (2006.01) |
| ***A47G 1/14*** | (2006.01) |

(52) U.S. Cl.

CPC ..... *A47G 1/16* (2013.01); *A47G 1/14* (2013.01); *A47G 1/142* (2013.01); *A47G 2200/106* (2013.01)

(58) Field of Classification Search

CPC ..... A47G 1/065; A47G 2001/0672; A45D 40/221; A45D 2040/228

See application file for complete search history.

(56) References Cited

U.S. PATENT DOCUMENTS

| | | | | |
|---|---|---|---|---|
| 3,152,716 A * | 10/1964 | Feldhahn | A45C 13/005 16/320 |
| 3,673,723 A * | 7/1972 | Lazar | A47G 1/065 40/617 |
| 4,532,727 A * | 8/1985 | Klose | A47G 1/065 40/729 |
| 6,015,129 A | 1/2000 | Harrigan | |
| 6,070,749 A * | 6/2000 | Joulia | A45D 40/221 132/294 |
| 6,385,886 B1 * | 5/2002 | Chepikian | A47G 1/065 40/729 |

(Continued)

FOREIGN PATENT DOCUMENTS

GB 2519450 A 4/2015

OTHER PUBLICATIONS

International Search Report dated Oct. 12, 2017, for International application No. PCT/US2017/043030.

*Primary Examiner* — Bradley Duckworth
(74) *Attorney, Agent, or Firm* — Carter, DeLuca & Farrell LLP

(57) ABSTRACT

A device comprising a base having a first top surface and a first bottom surface, a first magnetic component, and a first attachment component; a cover having a second top surface and a second bottom surface, a first magnetic component, and a second attachment component, the second bottom surface configured to mate with the first top surface; wherein the first and second magnetic components are placed so as to hold the cover onto the base and to act as a swivel hinge, and wherein the first and second attachment components are configured to engage the base to the cover when the device is in an open position.

15 Claims, 11 Drawing Sheets

(56) References Cited

U.S. PATENT DOCUMENTS

| | | | | |
|---|---|---|---|---|
| 6,961,977 | B2 * | 11/2005 | Seidler | A45D 33/20 132/293 |
| 7,089,627 | B2 * | 8/2006 | Seidler | B65D 51/04 16/320 |
| 7,337,497 | B2 * | 3/2008 | Seidler | A45D 33/20 16/320 |
| 8,841,981 | B2 | 9/2014 | Fullerton et al. | |
| 9,713,397 | B2 * | 7/2017 | Shields | A47G 1/06 |
| 10,064,504 | B2 * | 9/2018 | Hogrefe | A47G 1/065 |
| 2004/0200755 | A1 * | 10/2004 | Gueret | A45D 40/221 206/581 |
| 2009/0100732 | A1 * | 4/2009 | Seidler | A47F 7/147 40/729 |
| 2010/0024271 | A1 * | 2/2010 | Seidler | A47F 7/147 40/711 |
| 2010/0083549 | A1 * | 4/2010 | Li | A47G 1/0616 40/728 |
| 2010/0229439 | A1 * | 9/2010 | Elliot | A47G 1/06 40/711 |
| 2012/0023798 | A1 * | 2/2012 | Seidler | A47G 1/065 40/711 |
| 2012/0027963 | A1 | 2/2012 | Dube et al. | |
| 2015/0239203 | A1 * | 8/2015 | Norcross | B32B 3/266 428/99 |

* cited by examiner

FIG 5A
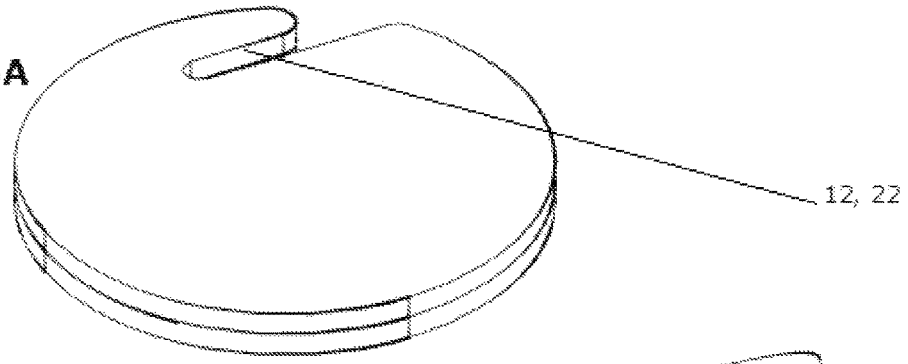
FIG 5B
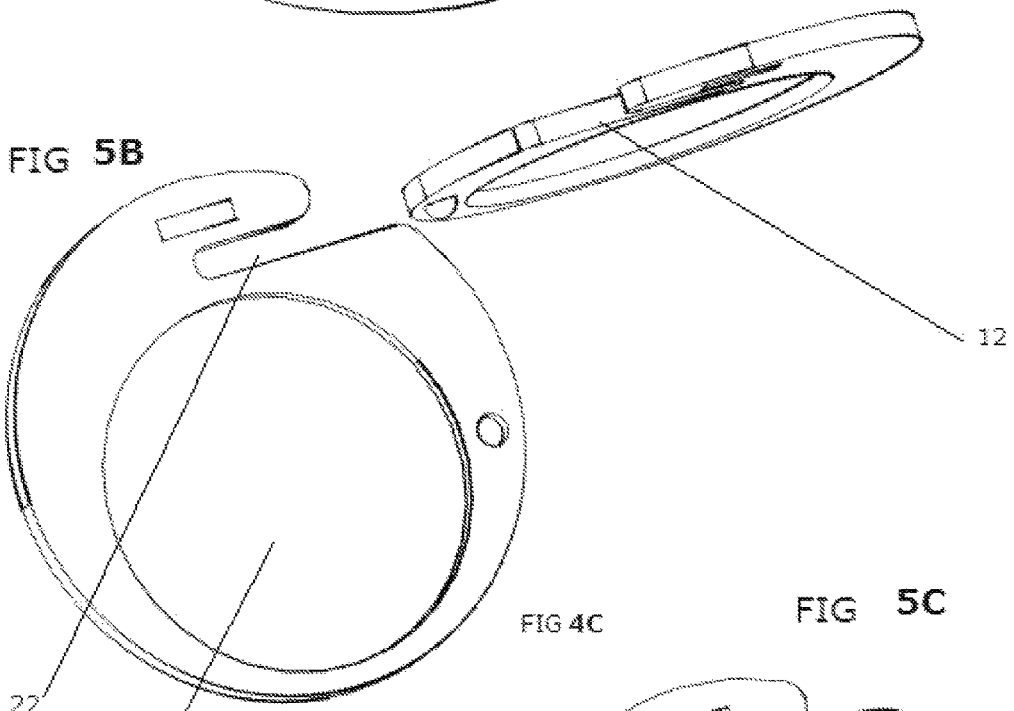
FIG 4C
FIG 5C
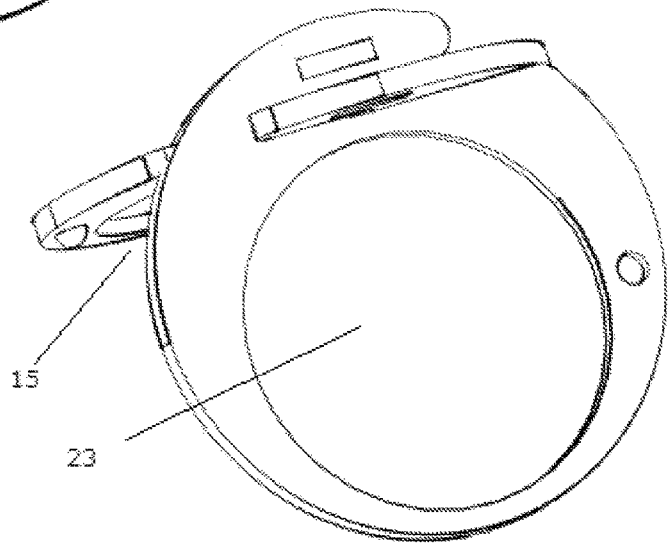

FIG 7A
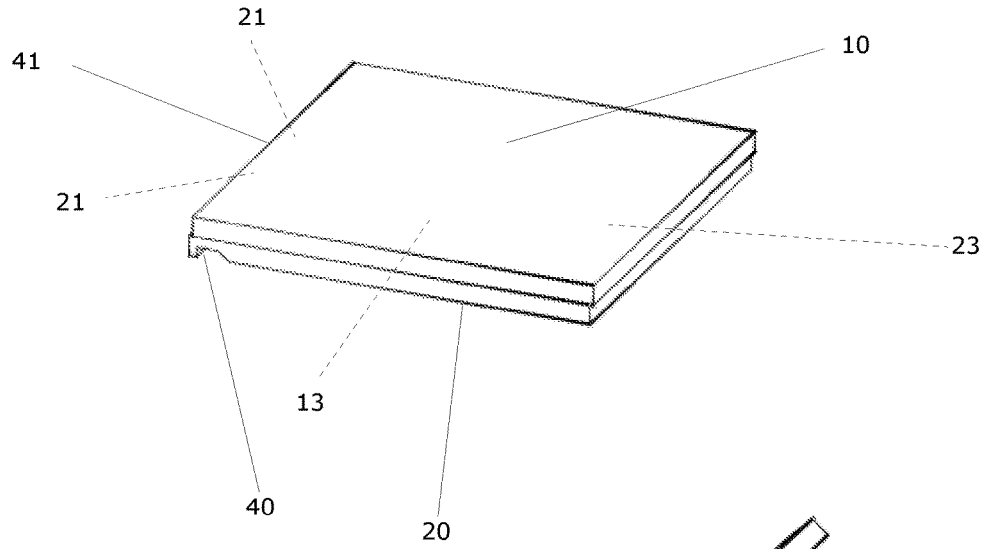
FIG 7B
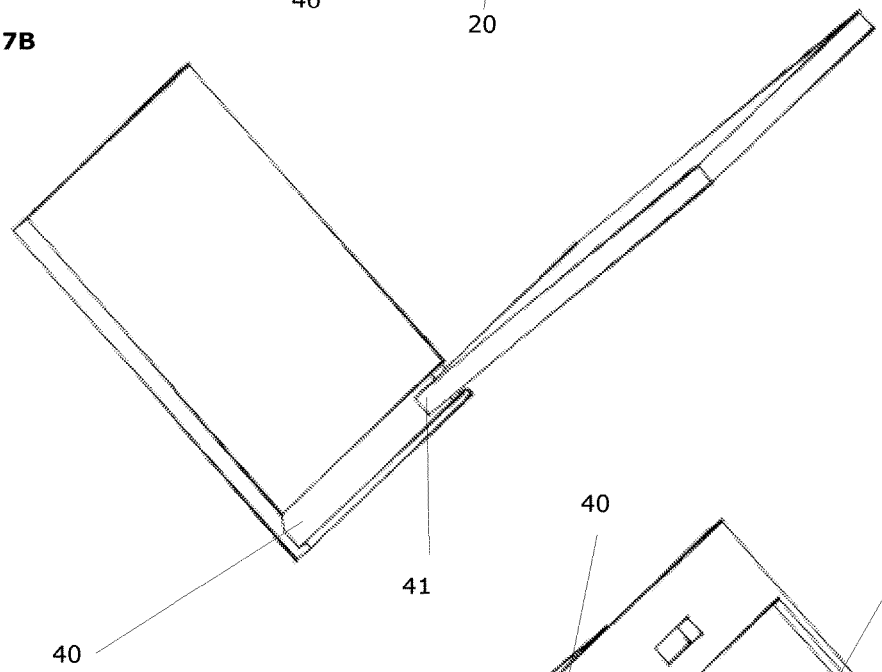
FIG 7C
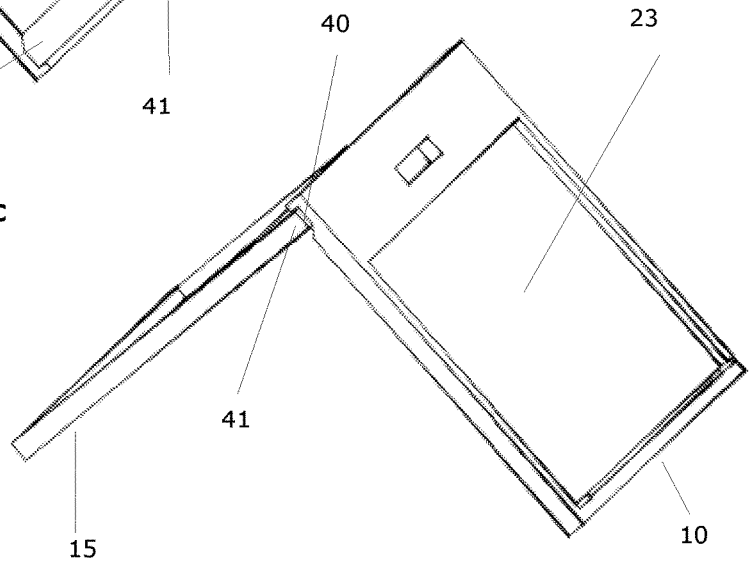

DETACHABLE SELF-SUPPORTING DISPLAY DEVICE

CROSS-REFERENCE TO RELATED APPLICATION

This application claims priority to U.S. Provisional Patent Application No. 62/365,702, filed Jul. 22, 2016, and entitled "DETACHABLE SELF-SUPPORTING DISPLAY DEVICE," the entire contents of which are incorporated herein by reference.

INTRODUCTION

The present description describes a display device with a cover and a base that is connected by a magnet or similar temporary connecting device when in its closed position and, when detached and repositioned, presents itself as a self-supporting display device when positioned on top of a flat surface such as a table top. Furthermore, the cover of the device may be rotated relative to the base such that the base may support the cover by virtue of a magnetic connector, allowing a viewer to view the contents of a display area.

One aspect comprises a device comprising: (a) a base having a first top surface and a first bottom surface, a first magnetic component, and a first attachment component; (b) a cover having a second top surface and a second bottom surface, a first magnetic component, and a second attachment component, said second bottom surface configured to mate with said first top surface; wherein said first and second magnetic components are placed so as to hold the cover onto the base and to act as a swivel hinge, and wherein said first and second attachment components are configured to engage said base to said cover when said device is in an open position.

In various exemplary embodiments: (1) the first and second attachment components are slots that engage orthogonally; (2) the first and second attachment components are a peg and a hole; (3) the first and second attachment components are an edge and a slot; (4) the first and second attachment components comprise magnetically attachable materials; (5) the magnetically attachable materials comprise a north pole magnet and a south pole magnet; (6) the base is rotatable with respect to the cover via the magnetically attachable materials; (7) the first and second attachment components comprise hook-and-loop material; (8) the first and second attachment components comprise a semi-adhesive.

The above and other features, aspects, and advantages of specific embodiments will become evident to those skilled in the art from a reading of the present disclosure.

BRIEF DESCRIPTION OF DRAWINGS

FIGS. 5A-5C show the sequence of how the preferred embodiment may be converted to a self-supporting display device.

FIGS. 7A-7C show how the alternative slot and top-edge version is converted to a self-supporting display device.

DESCRIPTION OF SELECT EXEMPLARY EMBODIMENTS

An embodiment of the device may be used as a mirror compact, though the device also may be used for other applications. Mirror compacts traditionally contain a cover and a base, and are connected by a mechanical hinge. The use of such devices are restricted by a solid hinge that prevents the mirror from rotating for optimal viewing. Furthermore, because a mechanical hinge requires a relatively straight edge for the hinge to function properly, the shape of the mirror compact is restricted to straightedge shapes such as rectangles.

An embodiment allows the user to detach the cover from the base and reposition it such that it is self-supporting when placed upon a relatively flat surface such as a table. Alternatively, the user can take advantage of the ability to rotate the magnetically coupled cover and base relative to each other such that the base and cover remain coupled, but allowing the user to expose the mirror for viewing while, simultaneously using either the cover or base as a handle.

Figure 1A:
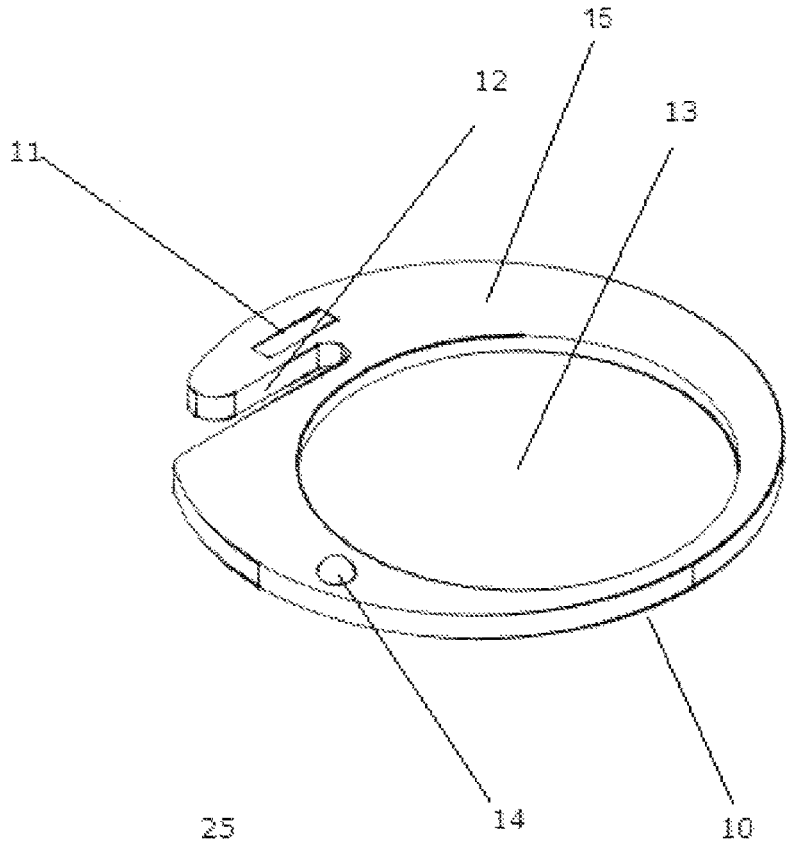
FIGS. 1A and 1B depict exemplary components of an exemplary embodiment of the display device.

FIG. 1A shows the cover 10 with a south-facing magnet connector 11 embedded into a cover inner surface 15. There is a cover display area 13 into which is places a mirror, photo, or clock. There is a cover stabilizer male component 14 and a cover slit 12.

Figure 1B:
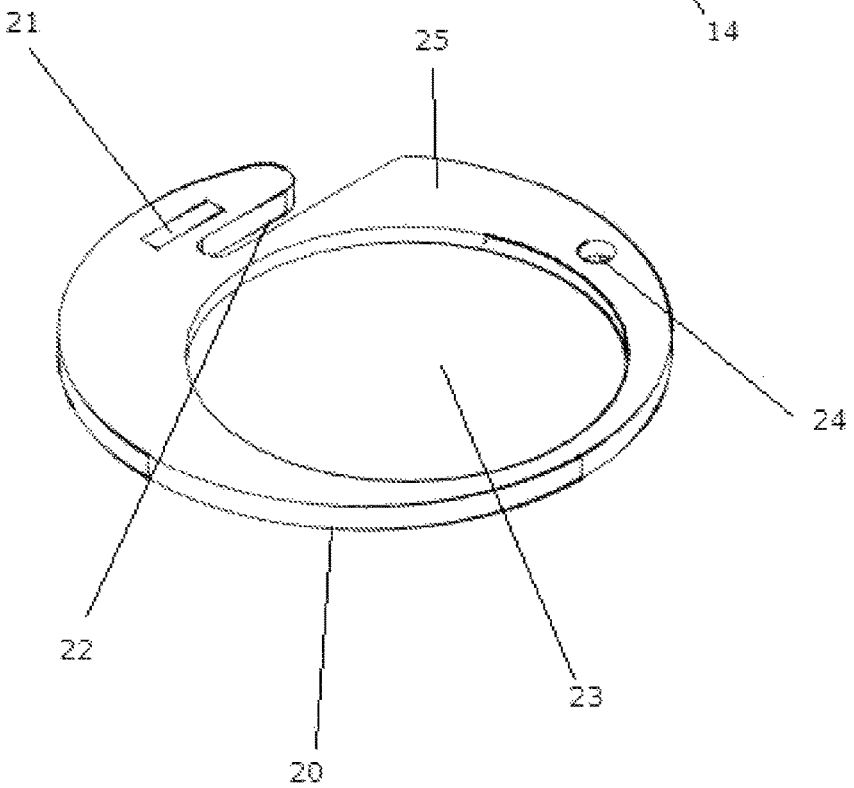

FIG. 1B shows the base 20 with a north-facing magnet connector 21 embedded into a base inner surface 25. There is a base display area 23 into which is places a mirror, photo, or clock. There is a base stabilizer female component 24 and a base slit 22.

Figure 2A:
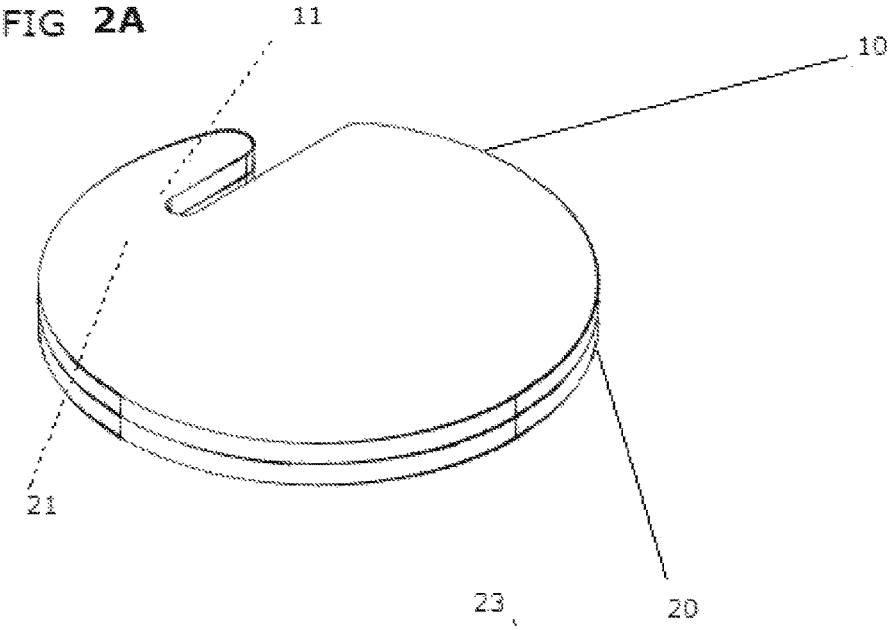
FIGS. 2A and 2B show an exemplary embodiment of the display device in fully closed position and an open position.

FIG. 2A shows the display device in a fully closed position. The cover 10 and the base 20 are fully aligned and the south-facing magnet connector 11 magnetically engages the north-facing magnet connector 21. The magnets are sufficiently strong such that the base and cover remain in a closed position until intentionally rotated or disengaged into an open position. It should be clear that the north- and south-facing magnet connectors are interchangeable as long as they can engage with each other and keep the display device closed while it is in a closed position.

Figure 2B:
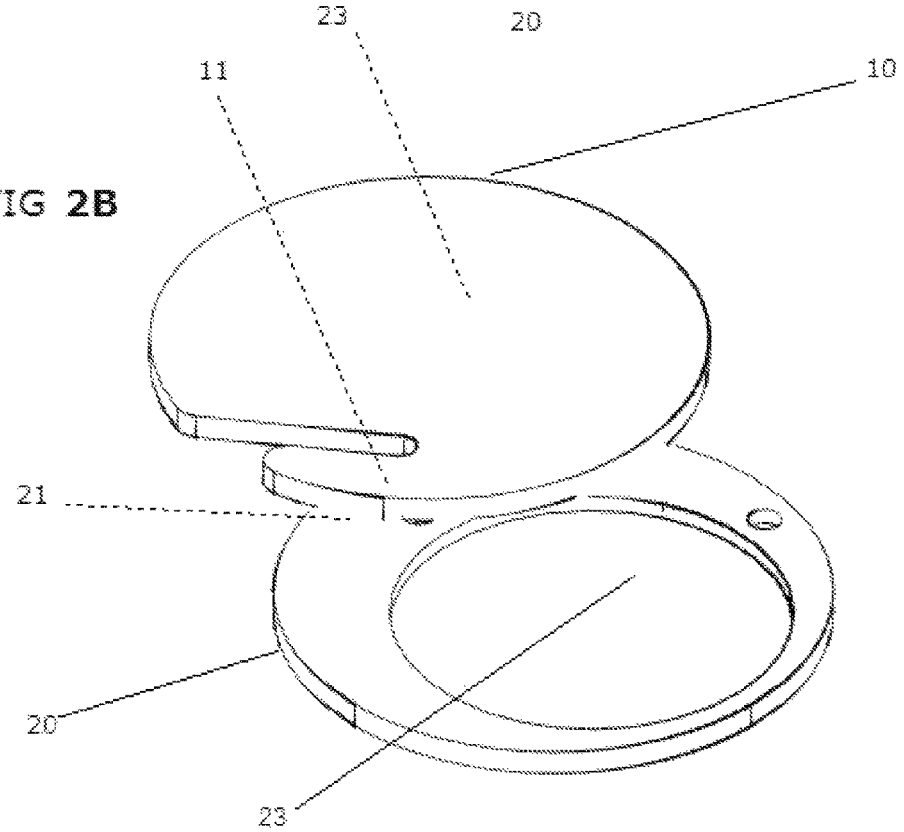

FIG. 2B shows the display device in an open position. In the present embodiment, the cover 10 is rotated relative to the base 20 about the axis formed by the south-facing magnet connector 11 and the north-facing magnet connector 21. During the rotation, the magnet connectors continue to be magnetically coupled and only move relative to one another about the rotational plane. Thus, the magnet connectors act, in this case, as a form of swivel hinge. The cover and base of the display device may also be completely separated and reattached in the described open position. Furthermore, the south- and north-facing magnet connectors may be replaced with another temporary adhering method such as "Velcro" (hook-and-loop). In any case, the cover inner display area 13 and base inner display area 23 are now completely accessible to be viewed.

Figure 3A:
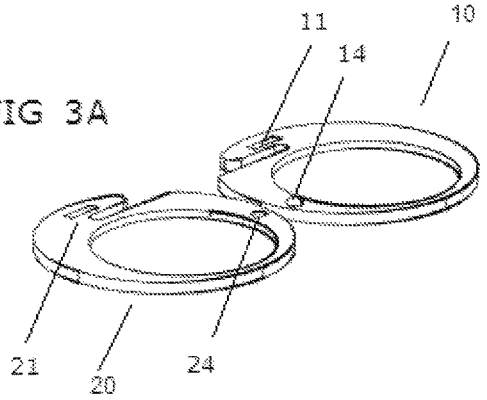
FIGS. 3A-3D describe how a mechanical stabilizer secures an exemplary embodiment of the display device when it is closed.
Figure 3B:
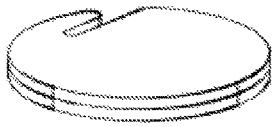
Figure 3C:
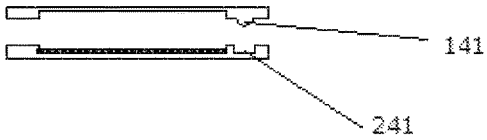
Figure 3D:
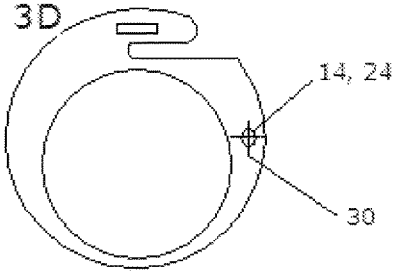

FIG. 3A describes the essential components of the stabilizing feature of the display device, and preventing it from rotating about the south 11 and north 21—facing magnets. The cover 10 and base 20 contain respectively a cover stabilizer male component 14 and a base component female component 24, and south 11 and north 21—facing magnet connectors. FIG. 3B shows the cover and base fully closed such that (as shown in the cross-sectional view FIG. 3C) the cover stabilizer male component 14 engages the base component female component 24. FIG. 3D shows how these components align along the same stability axis 30.

Figure 4A:
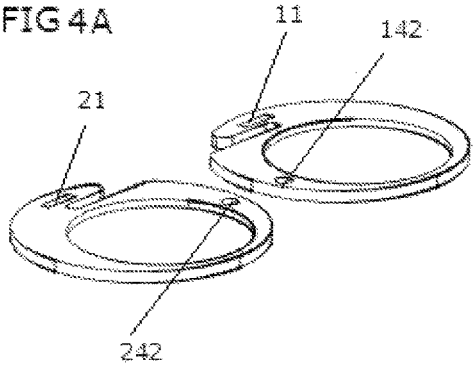
FIGS. 4A-4D describe how a magnetic stabilizer secures an exemplary embodiment of the display device when it is closed.
Figure 4B:
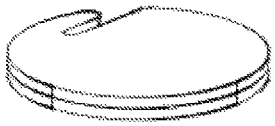
Figure 4D:
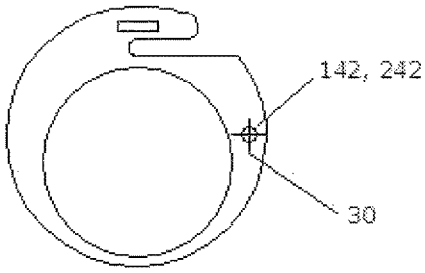
Figure 4C:
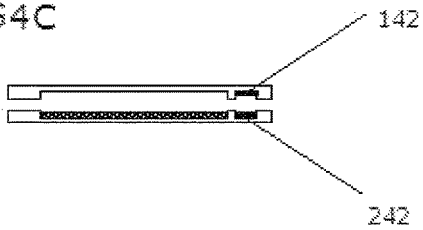

FIG. 4A shows how the cover stabilizer male component 14 and the base component female component 24 (described in FIG. 3A) may be replaced respectively by an additional set of magnets, namely a cover stabilizer north-facing magnet 142 and a cover stabilizer south-facing magnet 242. FIG. 4B shows the cover and base fully closed such that (as shown in FIG. 3C) the cover stabilizer north-facing magnet 142 engages the cover stabilizer south-facing magnet 242. FIG. 3D shows how these components align along the same stability axis 30. It is obvious that the north and south—facing magnets are interchangeable as long as they can engage with each other and stabilize the display device by preventing rotation of the cover relative to the base, while it is in a closed position.

FIGS. 5A-5C show the feature that allows a user to disengage the cover from the base and set the display device upon a surface such as a table top.

FIG. 5A shows the key components of this feature, namely a cover slit 12 and a base slit 22. The display device is in a fully closed position and the slits are aligned with one another.

FIG. 5B shows the display device with the cover and base fully detached. In this case the base display area 23 pointing forward and exposed to a viewer, and the cover slit 12 and base slit 22 positioned such that they may interlock with one another.

FIG. 5C shows the base and cover of the display device in a detached and interlocked position, set on a table top and allowing the display device to be self-supporting by virtue of the cover slit and base slit being fully engaged. The base display area 23 is viewable by an observer. In this embodiment, the cover display area 15 is not viewable. That said, the viewer may interchange the base and cover such that the cover display area is viewable and the base display area is not viewable. The cover and base display areas may contain any number of items, including mirrors, photographs, or clocks, or any combination of these items.

Figure 6A:
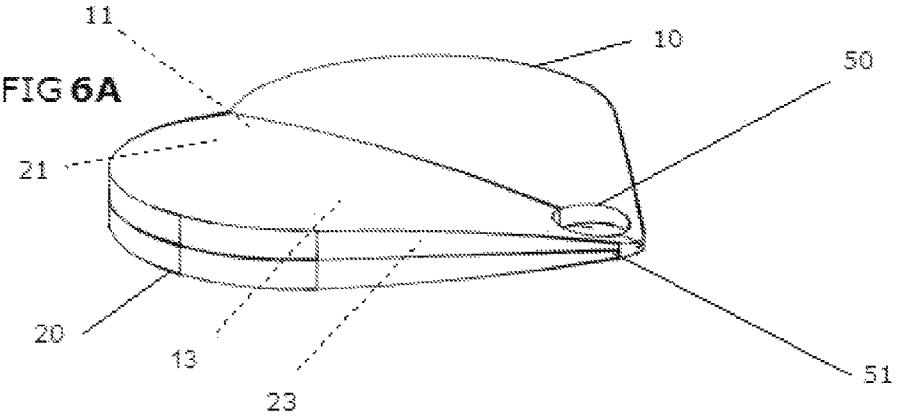
FIGS. 6A-6C show how the alternative peg-and-hole version is converted to a self-supporting display device.

FIG. 6A shows the essential components of the alternative peg-and-hole method to set the display on top of a surface. The cover and base slits shown in FIGS. 5A-5C are replaced by a hole 50 in one end of the cover 10, and a peg 51 built into a corresponding location on the base. As in the method described in FIGS. 5A-5C, the device contains south 11 and north 21—facing magnet connectors and cover 13 and base 23 display areas.

Figure 6B:
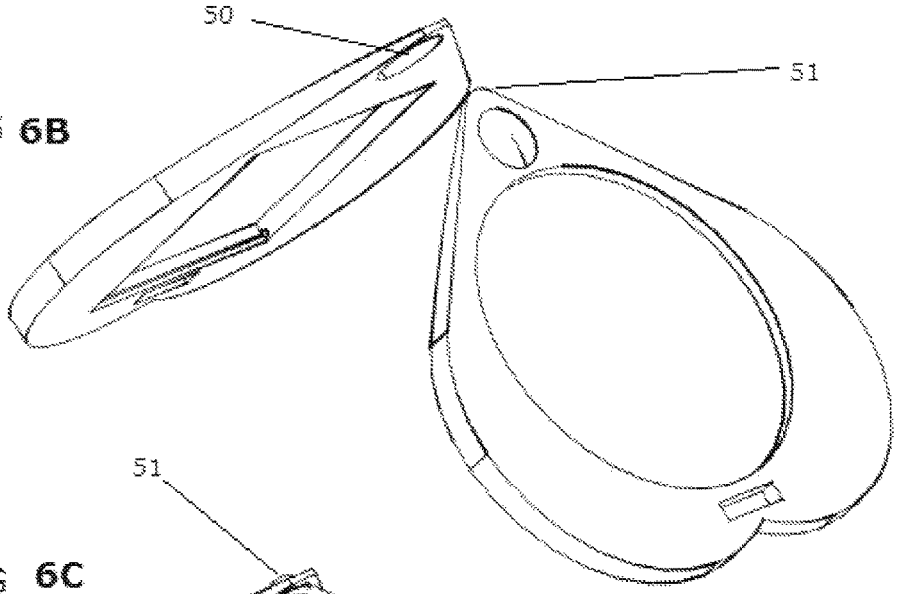

FIG. 6B shows how the peg 51 is about to engage the hole 50.

Figure 6C:
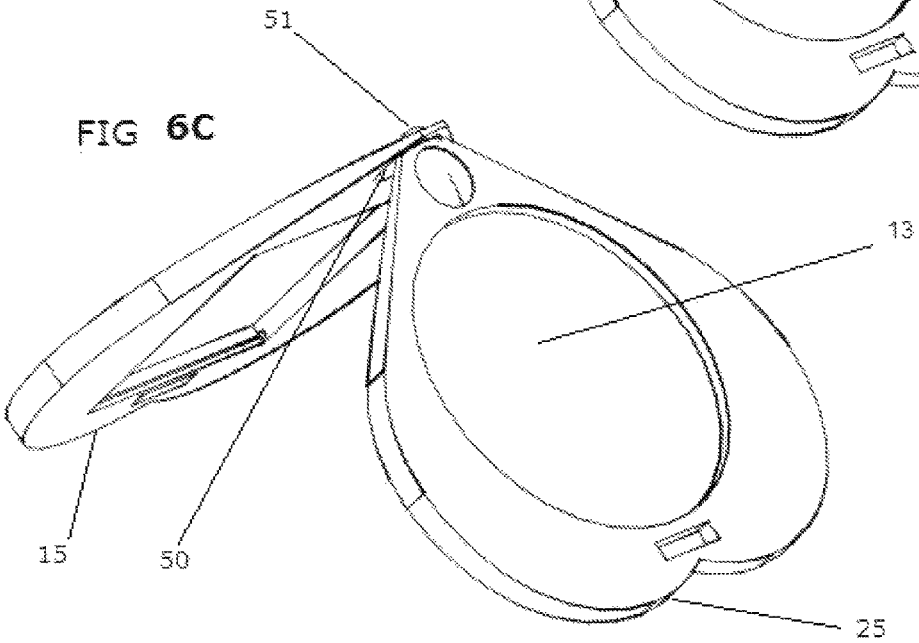

FIG. 6C shows the peg 51 fully engaged with the hole 50. The cover 10 and base 20 are set on top of a surface and self-supporting by virtue of the peg and hole being fully engaged.

FIG. 7A shows the essential components of the alternative slot and top edge method to set the display on top of a surface. The cover and base slits shown in FIGS. 5A-5C are replaced by a slot 40 in one end of the cover 10, and a top-edge 41 of one side of the base. As in the method described in FIGS. 5A-5C, the device contains south 11 and north 21 facing magnet connectors and cover 13 and base 23 display areas.

FIG. 7B shows how the top-edge 41 is about to engage the slot 40.

FIG. 7C shows the top edge 41 fully engaged with the slot 40. The cover 10 and base 20 are set on top of a surface and self-supporting by virtue of the top-edge and slot being fully engaged.

Figure 8:
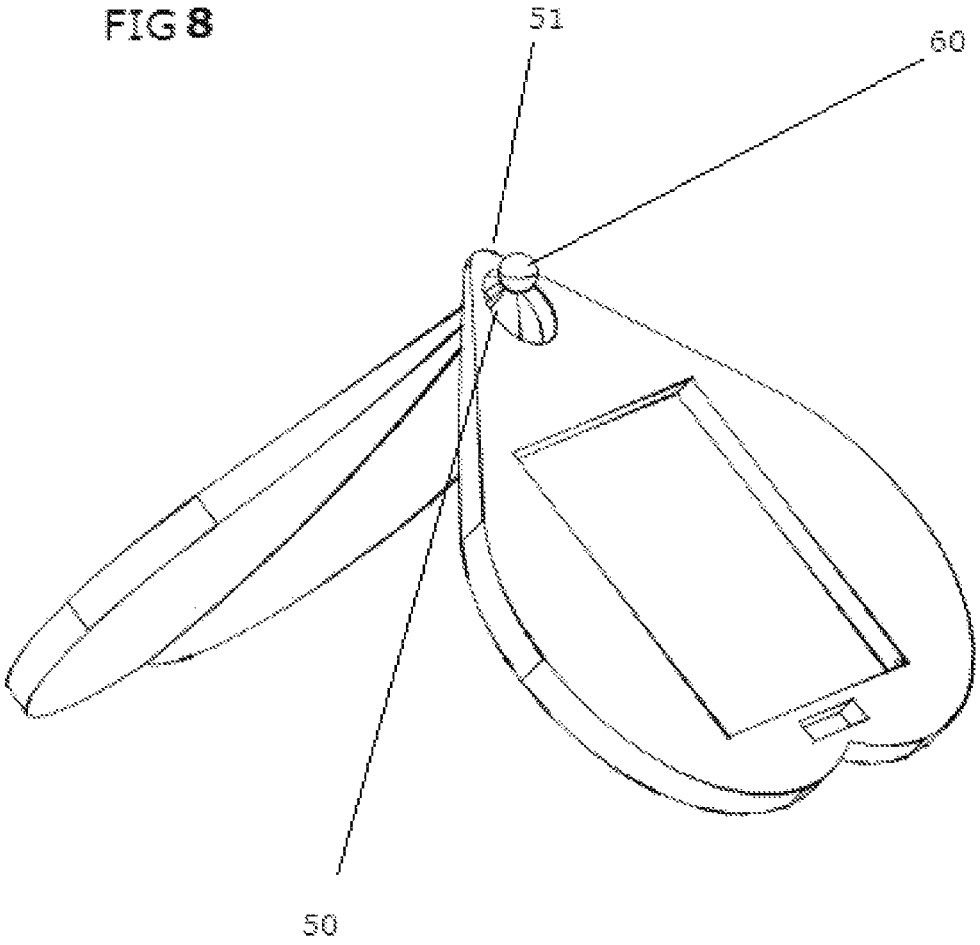
FIG. 8 shows a modification of the peg-and-hole version whereby the peg contains a small LED light.

FIG. 8 shows the device described in FIGS. 6A-6C where a small light source such as a LED bulb 60, is attached to the peg 51. This illuminates the item that is displayed or, I the display device is used as a mirror, the face of the user.

Figure 9A:
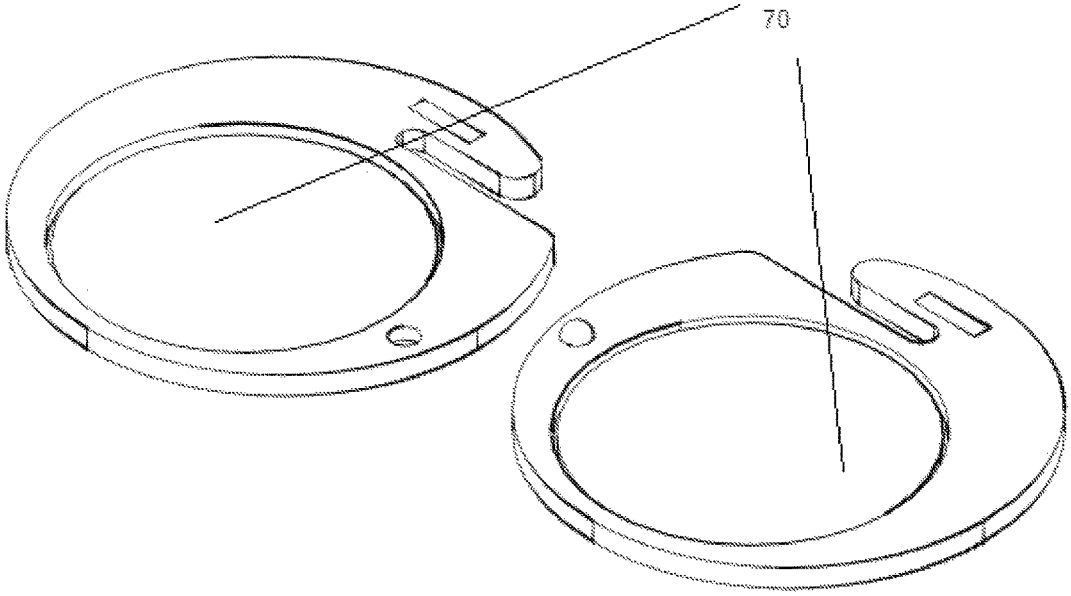
FIGS. 9A-9C shows various items that can be displayed in an exemplary embodiment of the device.
Figure 9B:
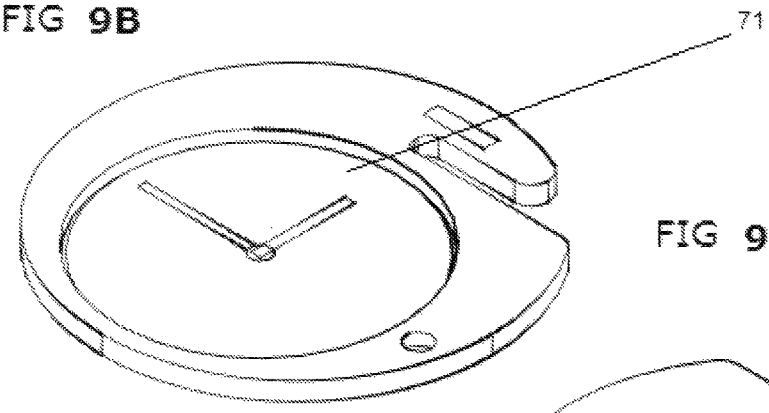
Figure 9C:
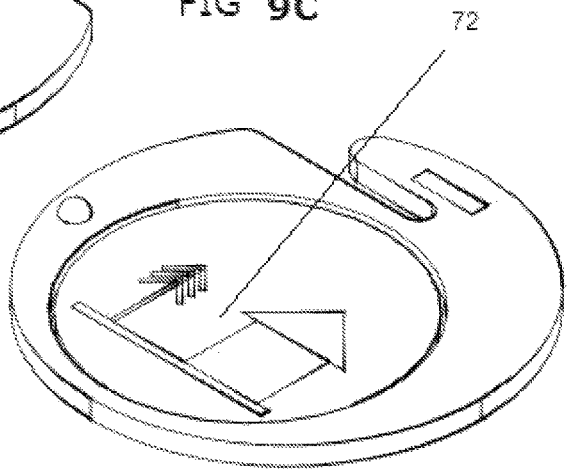

FIG. 9A-9C show various items that can be displayed in the device. As FIG. 9A shows, the cover and base could hold a pair of mirrors 70, one standard sized and the second mirror a magnifying mirror. FIG. 9B shows a clock 71 displayed in the base. FIG. 9C shows a photograph 72 displayed in the cover.

Figure 10:
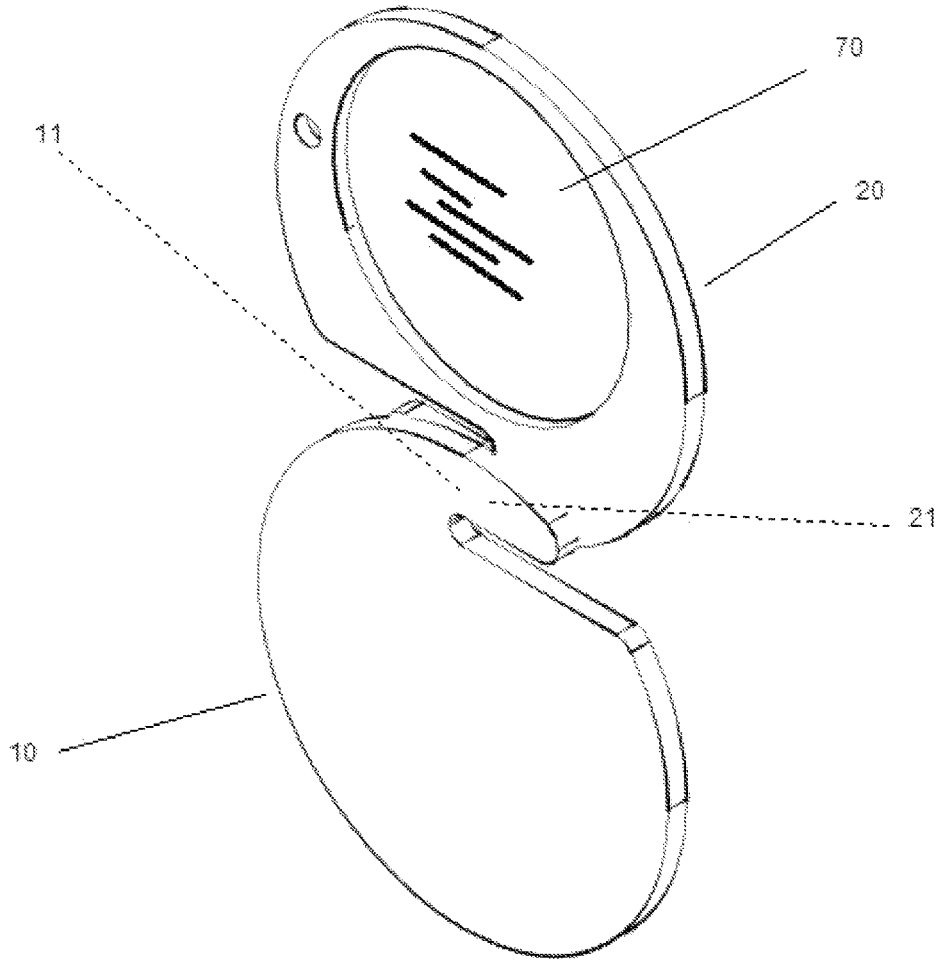
FIG. 10 shows how an exemplary embodiment of the device can be held as a handle.

FIG. 10 shows how the unit when in an open position can be held as a handled mirror. In this case, the cover 10 and base 20, have be rotated 180 degrees about the axis of the south-facing magnet connector and the north-facing magnet connector. The magnets are strong enough such that the base can be supported by the magnetic connection alone. In this case, the user can hold the cover section and support the base, thereby allowing the user to view the mirror 70 as he/she would a standard one-piece handled mirror.

Figure 11A:
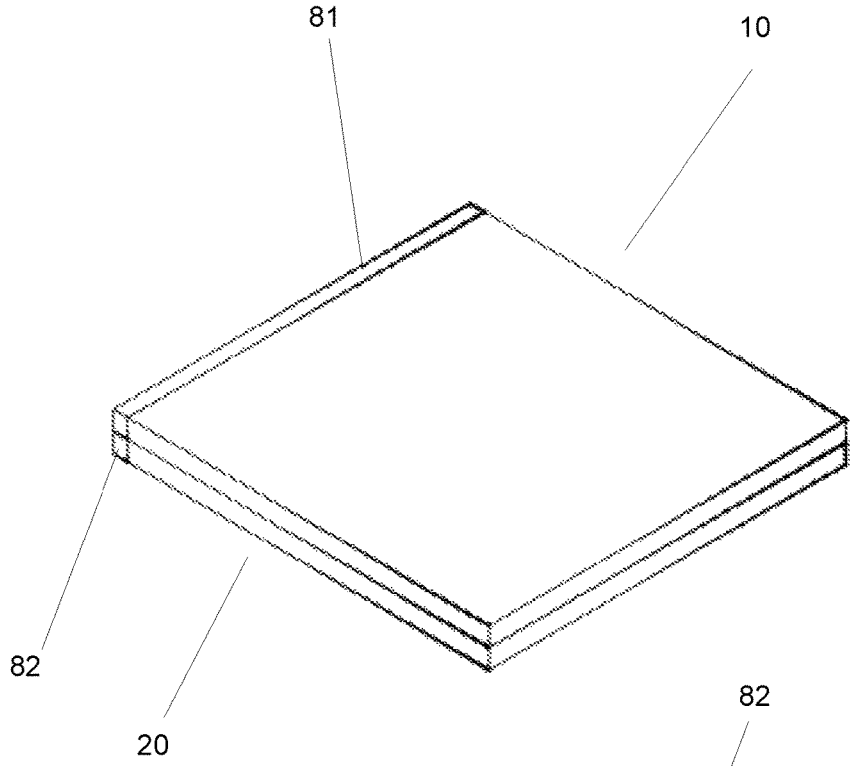
FIGS. 11A-11B show how the alternative magnetic method version is converted to a self-supporting display device.

FIG. 11A illustrates the essential components of the alternative magnetic method for setting the display on top of a surface. The cover and base slits shown in FIGS. 5A to 5C are replaced by a first magnetic material 81 incorporated in the cover 10 and a second magnetic material 82 incorporated in the base 20. The magnetic materials mentioned might comprise a pair of magnets whose orientations are such that the they are mutually attractive. Alternatively, one magnetic material can be a magnet and the other magnetic material could be a metallic material susceptible to magnetic attraction. The magnetic materials may be rubber magnets which, though relatively weak are sufficient to allow the cover and base to be stably connected on a surface.

Figure 11B:
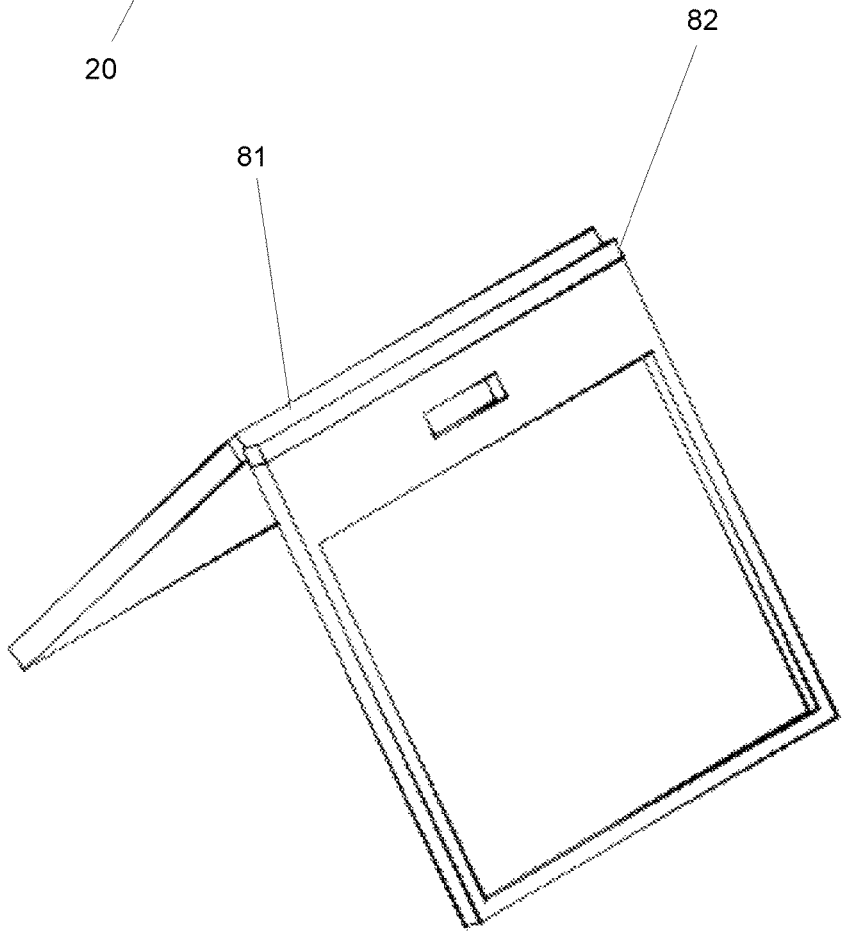

FIG. 11B shows a stably connected cover and base and displaying their contents. The first magnetic component 81 and now connected to the second magnetic component 82.

Figure 12A:
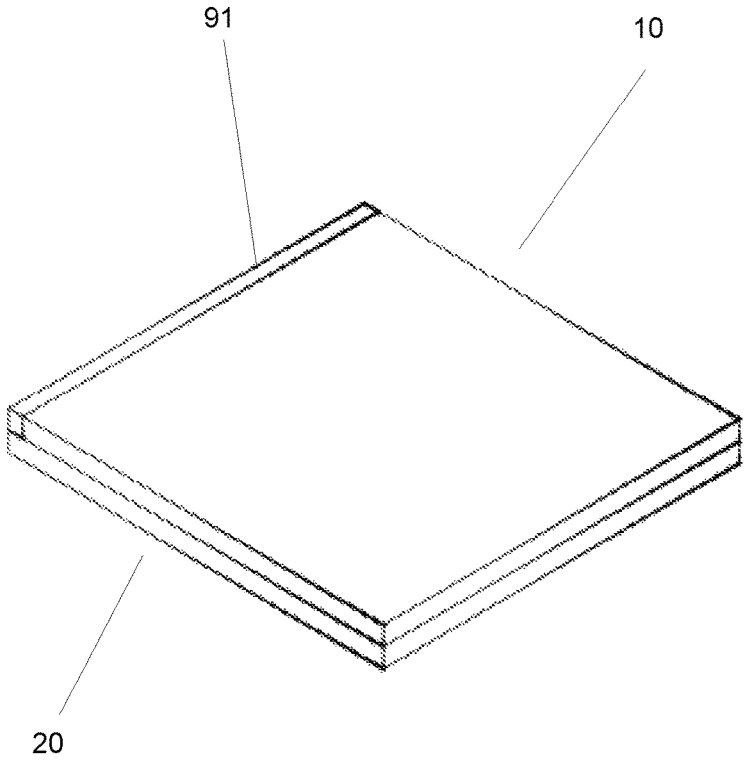
FIGS. 12A-12B show how the alternative friction material method version is converted to an exemplary embodiment of a self-supporting display device.
Figure 12B:
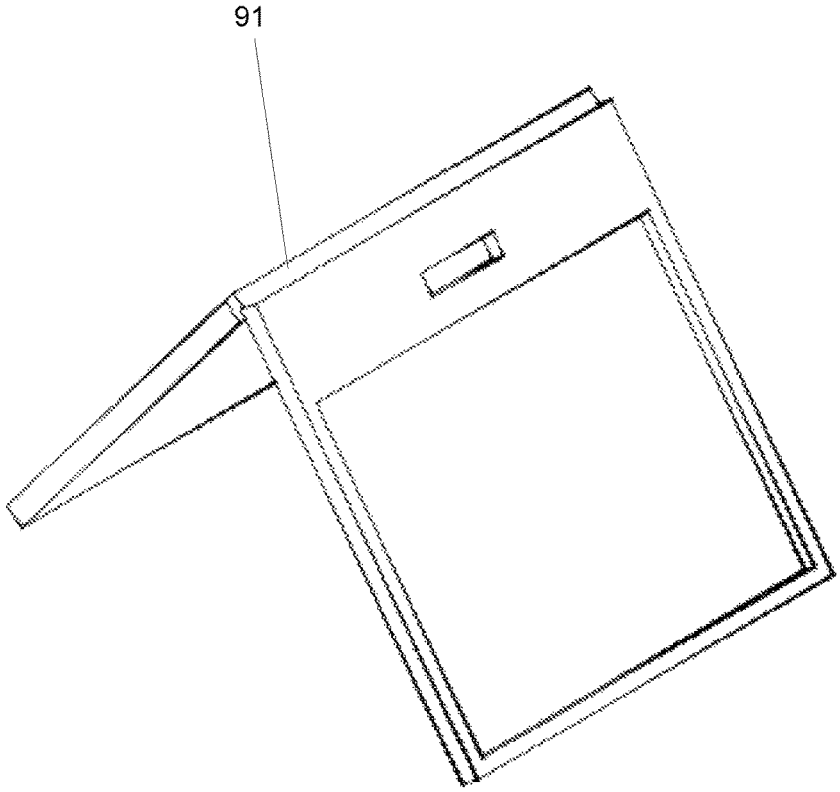

FIG. 12A illustrates certain components of the alternative magnetic method for setting the display on top of a surface. The cover and base slits shown in FIGS. 5A-5C are replaced by a friction material 91 incorporated in the cover 10. The base 20 may or may not incorporate an additional friction material. Examples of suitable friction materials may include one or two semi-adhesives such as silicone imbued with an adhesive chemical.

FIG. 11B shows a stably connected cover and base and displaying their contents. The friction material 91 is connected to the surface of the base 20.

As will be clear from the above description and appended drawings, in various embodiments: (a) the cover and base may have edges that are not straight; (b) the base may be of a different shape from the cover; (c) the base may be of a different size from the cover; (d) the base or cover may have a mirror incorporated within; (e) the base or cover may display a photograph or picture; (f) the base or cover may contain a holding device; (g) the holding device may incorporate a door; (h) the base may be interchangeable with another base; and/or (i) the base or cover may incorporate more than one magnetic closure.

While this invention has been described in conjunction with the exemplary embodiments outlined herein, many alternatives, modifications and variations will be apparent to those skilled in the art. Accordingly, the exemplary embodiments of the invention, as set forth herein, are intended to be illustrative, not limiting. Various changes may be made without departing from the spirit and scope of the invention.

What is claimed is:

1. A device comprising:

a base having a first top surface and a first bottom surface, a first magnetic component, a first mechanical attachment component, and a first end opposite the first mechanical attachment component; and a cover having a second top surface and a second bottom surface, a second magnetic component, a second mechanical attachment component, and a second end opposite the second mechanical attachment component, the second bottom surface configured to mate with the first top surface, wherein in a first orientation, the first and second mechanical attachment components are disengaged, and the first and second magnetic components are engaged so as to magnetically hold the cover onto the base and to permit the cover and the base to swivel with respect to each other about a position of the first and second magnetic components, and wherein in a second orientation, the first and second magnetic components are disengaged, the first and second mechanical attachment components directly engage and contact each other with the first end opposite the first mechanical attachment component contacting a surface and the second end opposite the second mechanical attachment component contacting the surface, such that the base and the cover are self-supported in the second orientation.

2. The device of claim 1, wherein the first and second mechanical attachment components are slots that engage orthogonally.

3. The device of claim 1, wherein the first and second mechanical attachment components are a peg and a hole.

4. The device of claim 1, wherein the first and second mechanical attachment components are an edge and a slot.

5. The device of claim 1, wherein the first and second magnetic components are a magnet and a magnetically attachable material.

6. The device of claim 1, wherein the first and second magnetic components are a north pole magnet and a south pole magnet.

7. The device of claim 1, wherein the first and second mechanical attachment components comprise hook-and-loop material.

8. The device of claim 1, wherein the first and second mechanical attachment components comprise a non-permanent adhesive.

9. The device of claim 1, wherein the cover and the base have an identical shape.

10. The device of claim 9, wherein the first and second mechanical attachment components have an identical shape.

11. The device of claim 1, wherein in the first orientation, the cover and the base are parallel to each other.

12. The device of claim 11, wherein in the second orientation, the cover and the base are oblique to each other.

13. The device of claim 1, wherein in the second orientation, the cover and the base are oblique to each other.

14. The device of claim 1, wherein at least one of the cover or the base includes an item for display.

15. The device of claim 14, wherein at least one of the cover or the base is configured as a handle such that in the first orientation, swiveling the cover and the base with respect to each other causes one of the cover or the base to operate as the handle while the item for display is revealed.

* * * * *